US006578496B2

(12) United States Patent
Guard et al.

(10) Patent No.: US 6,578,496 B2
(45) Date of Patent: Jun. 17, 2003

(54) HIGHCHAIR TRAY WITH REMOVABLE INSERTS

(75) Inventors: Tony Michael Guard, Union, KY (US); Joseph Robert Stephens, Middletown, OH (US); James Louis Tobergta, Batavia, OH (US)

(73) Assignee: Gravity, Incorporated, Cincinnati, OH (US)

( * ) Notice: Subject to any disclaimer, the term of this patent is extended or adjusted under 35 U.S.C. 154(b) by 0 days.

(21) Appl. No.: 09/812,650

(22) Filed: Mar. 20, 2001

(65) Prior Publication Data

US 2001/0035112 A1 Nov. 1, 2001

Related U.S. Application Data

(60) Provisional application No. 60/190,537, filed on Mar. 20, 2000.

(51) Int. Cl.[7] ..... A47B 85/00

(52) U.S. Cl. ..... 108/25; 108/90; 297/148

(58) Field of Search ..... 108/25, 26, 90; 297/148, 153

(56) References Cited

U.S. PATENT DOCUMENTS 1,557,636 A 10/1925 Warner 2,402,861 A 6/1946 Winnick (List continued on next page.)

*Primary Examiner*—Jose V. Chen

(74) *Attorney, Agent, or Firm*—Haverstock, Garrett & Roberts LLP

(57) ABSTRACT

A tray assembly for an infant highchair, the tray assembly including a frame having front, rear, and side peripheral edge portions defining a space therebetween having a predetermined shape and size; a tray insert having front, rear, and side peripheral lip portions supporting and connected to a bottom portion located in an area defined thereby, the tray insert having a predetermined shape and extent such that the peripheral lip portions can rest on the peripheral edge portions of the frame for supporting the bottom of the tray insert in at least substantially covering relation to the space defined by the frame. A handle is connected to the front peripheral lip of the tray insert having a generally C shape profile when viewed from the side, and being positioned so as to releasably wrap or clamp securely around a sufficient portion of the front peripheral edge portion of the frame for holding the front lip portion of the tray insert thereon when the side and rear lip portions of the tray insert are resting on the side and rear edge portions of the frame, respectively; the tray insert being simply and easily removably from the frame by grasping the handle with one hand and pulling the handle forwardly to release the handle from the front peripheral edge portion of the frame and replaceable in a similar manner.

33 Claims, 4 Drawing Sheets

U.S. PATENT DOCUMENTS

| | | | | |
|---|---|---|---|---|
| 267,182 | A | | 3/1954 | Gwin et al. |
| 2,726,838 | A | | 12/1955 | Ripley, Jr. |
| 2,935,122 | A | | 5/1960 | Miller |
| 3,143,374 | A | | 8/1964 | Carboni |
| 3,204,367 | A | | 9/1965 | Stubbmann |
| 3,415,570 | A | | 12/1968 | Mosley et al. |
| 3,470,052 | A | | 10/1969 | Kaposi |
| 3,512,297 | A | | 5/1970 | Malherbe et al. |
| 3,635,522 | A | * | 1/1972 | Kerwit |
| 3,729,037 | A | | 4/1973 | Dare et al. |
| D229,999 | S | | 1/1974 | Blazey et al. |
| 4,094,547 | A | | 6/1978 | Zampino et al. |
| 4,427,391 | A | * | 1/1984 | Berman |
| 4,606,576 | A | | 8/1986 | Jones |
| 4,640,033 | A | | 2/1987 | Bulger |
| 5,071,149 | A | | 12/1991 | Perego |
| D326,123 | S | | 5/1992 | Connon |
| D328,624 | S | | 8/1992 | Hu |
| D333,060 | S | | 2/1993 | Perego |
| D339,772 | S | | 9/1993 | Hu |
| 5,254,007 | A | | 10/1993 | Eagan |
| 5,294,172 | A | | 3/1994 | Dubus |
| 5,348,368 | A | | 9/1994 | Garcia et al. |
| D356,531 | S | | 3/1995 | Valenti |
| D364,896 | S | | 12/1995 | Wu |
| 5,527,090 | A | | 6/1996 | Cone, II |
| 5,558,391 | A | | 9/1996 | Chavous |
| 5,560,653 | A | | 10/1996 | Beppu |
| 5,586,800 | A | | 12/1996 | Triplett |
| 5,590,939 | A | * | 1/1997 | Piontek |
| 5,660,432 | A | | 8/1997 | Davis |
| D383,338 | S | | 9/1997 | Gibbs |
| 5,662,378 | A | | 9/1997 | Carruth |
| 5,720,226 | A | * | 2/1998 | Padovano |
| 5,810,432 | A | * | 9/1998 | Haut et al. |
| D402,931 | S | | 12/1998 | Huang |
| 5,975,628 | A | | 11/1999 | Russell |
| 6,119,996 | A | | 9/2000 | Connery |
| 6,179,377 | B1 | * | 1/2001 | Harper |
| 6,216,605 | B1 | | 4/2001 | Chapman |
| D447,445 | S | | 9/2001 | Lu |
| 6,298,793 | B1 | * | 10/2001 | Turner et al. |
| 6,349,654 | B1 | * | 2/2002 | Peters |

* cited by examiner

HIGHCHAIR TRAY WITH REMOVABLE INSERTS

This application claims the benefit of Provisional application Ser. No. 60/190,537, filed Mar. 20, 2000.

TECHNICAL FIELD

This invention relates generally to infant highchairs, and more particularly, to a tray for a highchair including at least one removable insert having an eating surface, at least one toy, and/or other objects thereon, which tray inserts are easily removable by an adult, but difficult to remove by a child or an infant, and are suitable for cleaning under high temperature environmental conditions typically found in a conventional automatic dishwashing machine.

BACKGROUND ART

It is well known to provide trays for infant highchairs, invalid seats, wheelchairs, child car seats and the like, which have removable covers or inserts. Reference in this regard Dare et al. U.S. Pat. No. 3,729,037, issued Apr. 24, 1973 which discloses a disposable highchair tray cover of paper or plastic formed or molded to conform to a chair tray top; Jones U.S. Pat. No. 4,606,576, issued Aug. 19, 1986, which discloses a tray for a highchair which can include a removable feeding bowl; Carruth U.S. Pat. No. 5,662,378, issued Sep. 2, 1997, which discloses a car seat with a tray for use by children which is removable, embedded in a shield of the car seat; and Chavous U.S. Pat. No. 5,558,391, issued Sep. 24, 1996, which discloses a tray with removable object supporting insert for use by disabled persons.

However, an important shortcoming of various of the above-referenced devices is the requirement of relatively complex and difficult to use means for attaching the removable items to, and detaching the removable items from, the various trays and other support structures. Additionally, at least in the instance of U.S. Pat. No. 3,729,037, the removable tray cover is not indicated as being dishwasher safe, and other of the disclosed devices appear to have no handles for ease of carrying, or require substantial dexterity for securing the removable item to, and removing it from the tray, as is apparent from the disclosure of U.S. Pat. No. 5,558,391.

Accordingly, the present invention is directed to overcoming one or more of the problems as set forth above.

DISCLOSURE OF THE INVENTION

In one aspect of the present invention, a tray assembly for an infant high chair is disclosed, the tray assembly including a frame having a front peripheral edge portion, a rear peripheral edge portions opposite the front peripheral edge portion, and opposing side peripheral edge portions extending between the front and rear peripheral edge portions, the peripheral edge portions defining a space therebetween having a predetermined shape and size; a tray insert having a front peripheral lip portion, a rear peripheral lip portion opposite the front peripheral lip portion, a pair of opposing side peripheral lip portions extending between the front and rear peripheral lip portions defining an area, and a bottom portion located in the area and connected to and supported by the peripheral lip portions, the tray insert having a predetermined shape and extent such that the peripheral lip portions can rest on the peripheral edge portions of the frame for supporting the bottom of the tray insert in at least substantially covering relation to the space defined by the frame. The present tray assembly importantly includes a handle on the front peripheral lip of the tray insert having a generally C shape profile when viewed from the side, positioned so as to releasably wrap or clamp securely around a sufficient portion of the front peripheral edge portion of the frame for holding the front lip portion of the tray insert thereon when the side and rear lip portions of the tray insert are resting on the side and rear edge portions of the frame, respectively; wherein the tray insert is removable from the frame by grasping the handle with one hand and pulling the handle forwardly to release the handle from the front peripheral edge portion of the frame.

According to another aspect of the present invention, a tray for an infant highchair is disclosed, including a frame having a front peripheral edge portion, a rear peripheral edge portion opposite the front peripheral edge portion, and opposing side peripheral edge portions extending between the front and rear peripheral edge portions, the peripheral edge portions defining a space therebetween having a predetermined shape and size; a tray insert having a front peripheral lip portion, a rear peripheral lip portion opposite the front peripheral lip portion, a pair of opposing side peripheral lip portions extending between the front and rear peripheral lip portions defining an area, and a bottom portion located in the area and connected to the peripheral lip portions, the tray insert having a predetermined shape and extent such that the peripheral lip portions can rest on the peripheral edge portions of the frame for supporting the bottom of the tray insert in at least substantially covering relation to the space of the frame; locking clips extending upwardly from the side peripheral edge portions of the frame and yieldably biased toward the space, the locking clips being cooperatively engageable with the side peripheral lips of the tray insert when resting on the side peripheral edge portions of the frame for releasably holding the tray insert on the frame, the tray insert being removable from the frame by applying force against at least one of the locking clips in a direction away from the tray insert and lifting the tray insert from the frame.

BEST MODE FOR CARRYING OUT THE INVENTION

Figure 1:
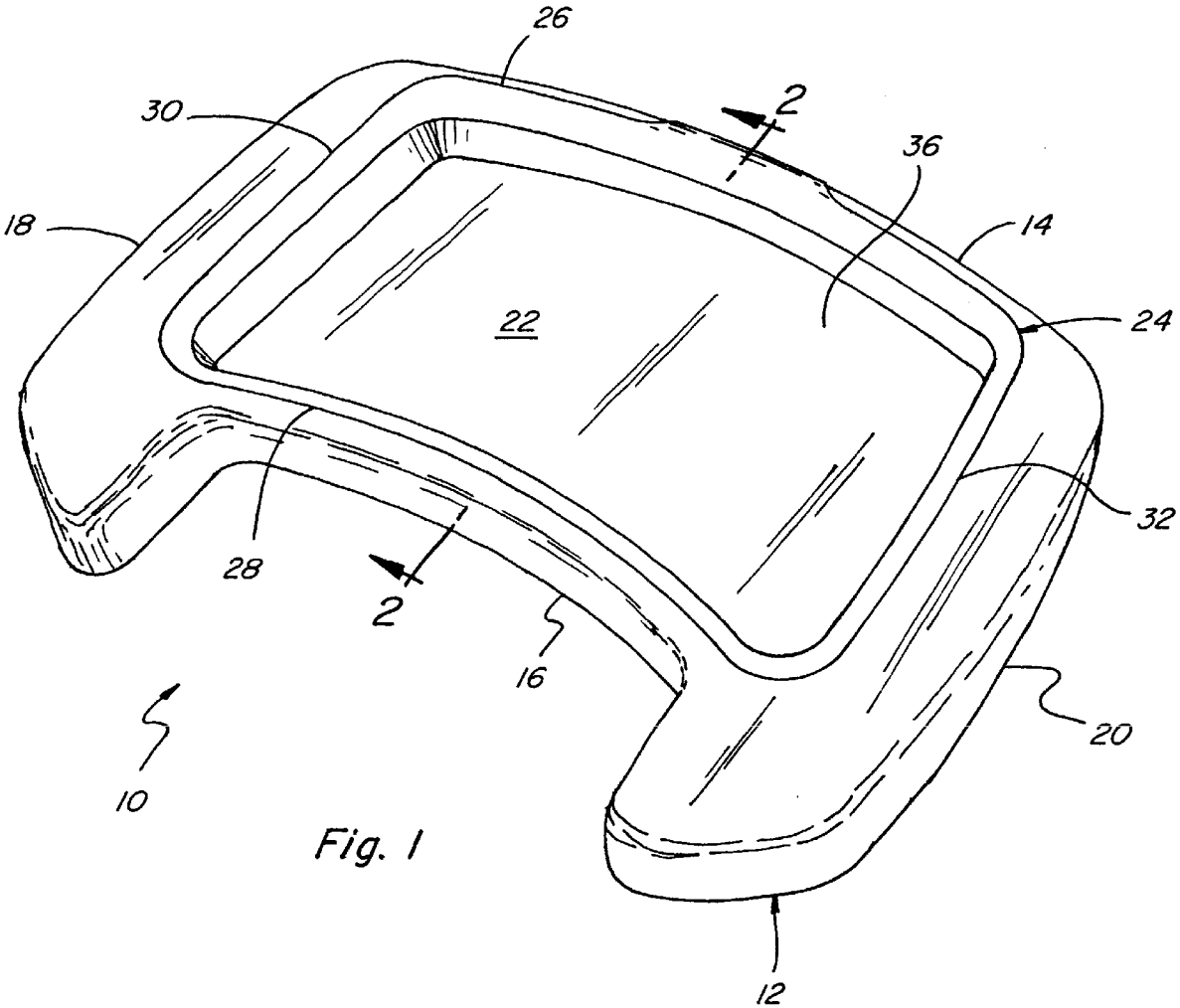
FIG. 1 is a perspective view of a tray assembly constructed and operable according to the teachings of the present invention.

Turning now to the drawings, FIG. 1 shows a preferred tray assembly 10 according to the present invention, including a frame 12 mountable to arms or other portions of a conventionally constructed and operable infant highchair, frame 12 having a front peripheral edge portion 14, a rear peripheral edge portion 16 opposite front peripheral edge portion 14, and opposing right and left side peripheral edge portions 18 and 20, respectively, extending between front and rear peripheral edge portions 14 and 16, peripheral edge portions 14, 16, 18, and 20 defining a space 22 therebetween having a predetermined shape and size. Here, space 22 has a generally rectangular shape, although it should be understood that it is contemplated according to the present invention for shape 22 to have a wide variety of other shapes, including a kidney shape, a fan shape, an ovoid shape, or any other shape suitable for a tray assembly such as disclosed herein.

Figure 2:
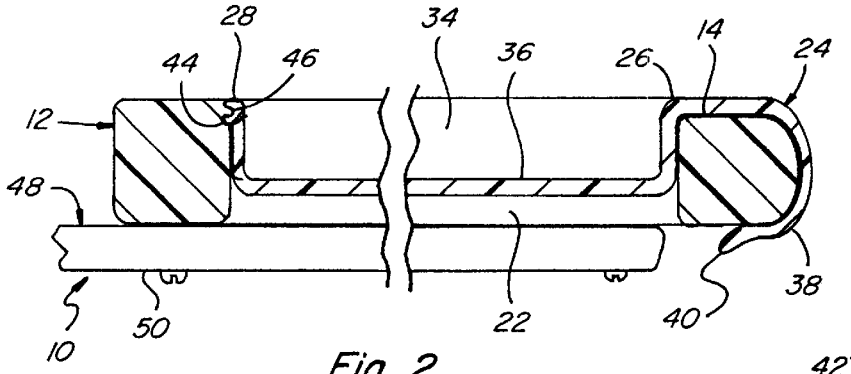
FIG. 2 is a fragmentary sectional view taken along line 2—2 of FIG. 1 showing cooperation between a tray insert and a frame of the tray assembly.
Figure 3:
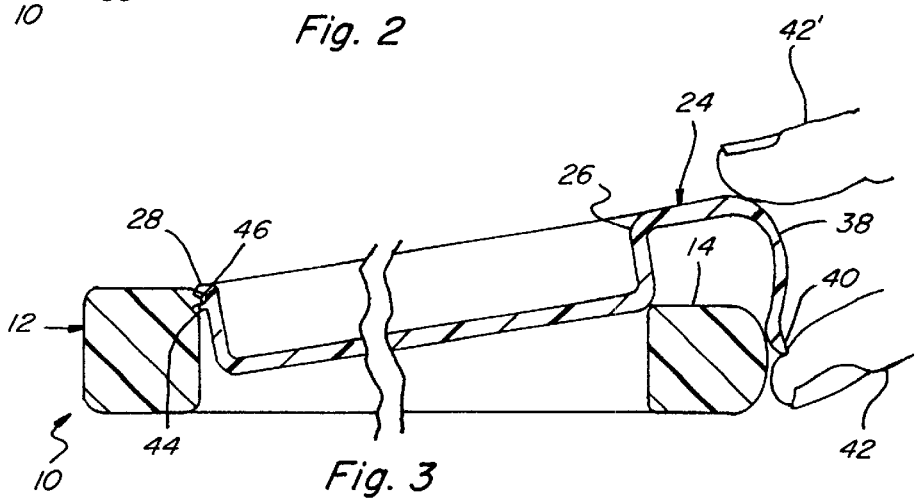
FIG. 3 is a fragmentary sectional view similar to FIG. 2 showing removal of the tray insert from the frame.

Referring also to FIGS. 2 and 3, tray assembly 10 includes a tray insert 24 having a front peripheral lip portion 26, a rear peripheral lip portion 28 opposite front peripheral lip portion 26, a left side peripheral lip portion 30, and a right side peripheral lip portion 32 extending between front and rear peripheral lip portions 26 and 28, lip portions 26, 28, 30, and 32 defining an area 34. A bottom portion 36 is located in area 34 and is connected to peripheral lip portions 26, 28, 30, and 32 around the periphery of bottom portion 36 to support bottom portion 36. As is evident, tray insert 24 has a predetermined shape and extent such that peripheral lip portions 26, 28, 30, and 32 can rest on peripheral edge portions 14, 16, 18, and 20 of frame 12, when bottom portion 36 is occupying or located in covering relation to space 22. Tray insert 24 additionally includes a handle 38 on front peripheral lip portion 26 at a location about midway between side peripheral lip portions 30 and 32, handle 38 extending outwardly from lip portion 26 and having a generally C shape profile when viewed from the side, as illustrated in FIGS. 2 and 3, handle 38 being positioned so as to releasably wrap or clamp securely around a sufficient portion of front peripheral edge portion 14 of frame 12 so as to intimately contact and hold front lip portion 26 of tray insert 14 on peripheral edge portion 14, when rear and side peripheral lip portions 28, 30, and 32, are resting on rear and side edge portions 16, 18, and 20 of frame 12, respectively.

Tray insert 24 is preferably made from a plastics material, such as, but not limited to, a polycarbonate, a polystyrene, a polyethylene, or a acrylonitrile butadiene styrene which will not deform or significantly degrade under temperature conditions typically found in a conventional household or commercial automatic dishwashing machine, which temperatures can be as high as about 250° F. or so.

Referring more particularly to FIGS. 2 and 3, the material of tray insert 24 and thickness and other structural characteristics thereof in the vicinity of and at the juncture of handle 38 and front peripheral lip portion 26, should be sufficient to allow handle 38 to retain the front portion of tray insert 24 in the position shown in FIG. 2 on frame 12, under opposing forces reasonably anticipated to be encountered with normal usage of tray assembly 10, for instance, such as can be anticipated to be applied in an upward direction by an infant either using his or her knees or hands against tray insert 24, but which also allows an adult or adolescent to grasp distal end 40 of handle 38 with a hand, a finger or fingers 42 and relatively easily flex, deform and/or upwardly lift handle 38 sufficiently to disengage it from around peripheral edge portion 14.

To hold and support rear lip portion 28 on frame 12 when handle 38 is wrapped or clamped on edge portion 14, rear peripheral lip portion 28 of tray insert 24 and rear peripheral edge portion 16 of frame 12 include cooperatively engageable elements 44 and 46, respectively, which here include an elongate receptacle or groove, and a corresponding elongate tab cooperatively receivable in the receptacle or groove. Then, when handle 38 of tray insert 24 is removed or disengaged from front peripheral edge portion 14 of frame 12 as explained above, elements 44 and 46 are simultaneously disengaged to allow easily removing tray insert 24 from frame 12 with one hand, using a simple, easy motion.

To attach tray insert 24 to frame 12, tray insert 26 is positioned generally as shown in FIG. 3, and a hand or a finger or fingers, as denoted at 42' is used to press down on tray insert 24 and/or handle 38 to bias or spread distal end 40 outwardly so that it wraps around front peripheral edge portion 14, elements 44 and 46 being simultaneously engaged, such that the tray insert 24 is locked on frame 12 in the position shown in FIGS. 1 and 2.

An important advantage achieved by tray assembly 10 is the ability to maintain frame 12 in position on the arms of a highchair, represented by highchair 48 and arm 50, for playing a role in retaining an infant in a seated position on the seat of the highchair (not shown) while tray insert 24 is removed for purposes which can include, but are not limited to, placing food thereon, other items thereon, or cleaning, so as not to increase the risk of the infant falling from, or otherwise undesirably exiting, the highchair.

Figure 4:
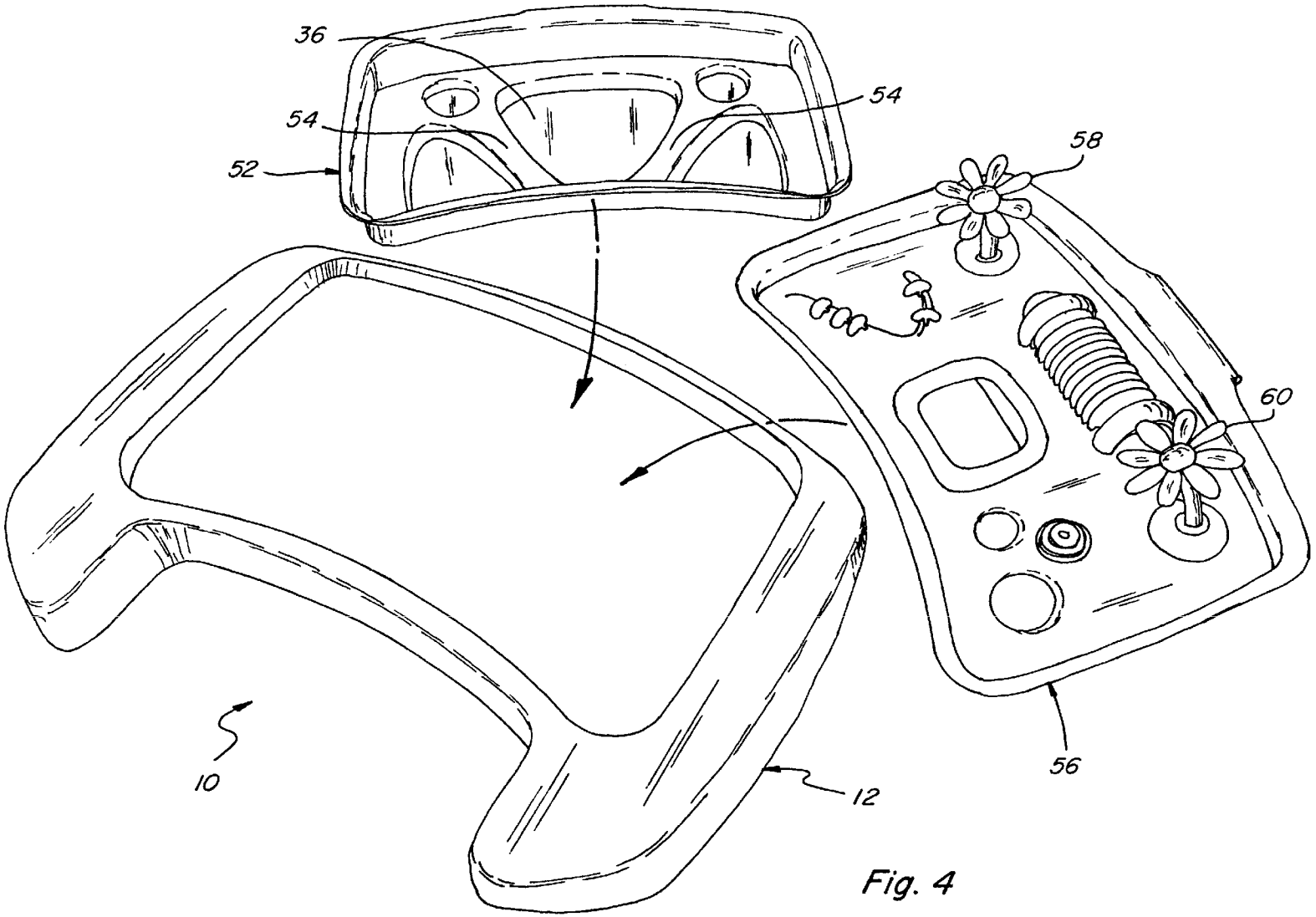
FIG. 4 is a perspective view of the frame of the tray assembly of FIG. 1 with several alternative tray inserts for use therewith.

Turning again to FIG. 4, as can be seen, tray assembly 10 can include a wide variety of alternative tray inserts in additional to insert 24, including a tray insert 52 having ribs 54 on bottom portion 36 dividing the top surface thereof into sections for holding food or other items; and a tray insert 56 including one or more toys, such as toys 58 and 60 on a top surface of bottom portion 36, for entertaining or distracting an infant sitting on the highchair, while food is being readied, or during other time periods.

Figure 5:
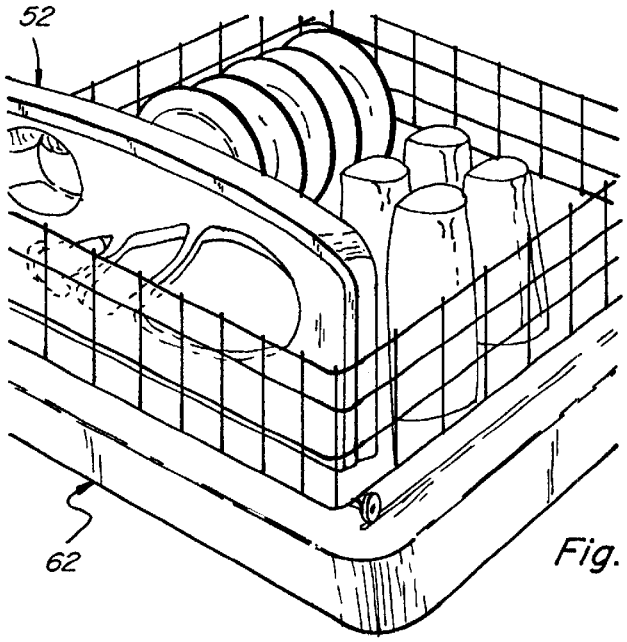
FIG. 5 is a perspective view of one of the trays of FIGS. 1–4 in a basket of a conventional dishwasher for washing therein.

Briefly referring to FIG. 5, an advantage of removable tray inserts 24, 52, and 56, is that they have a size, particularly an extent as measured between side peripheral lip portions 30 and 32, sufficiently small so as to be positionable in a basket or other receiver of a conventional commercial or household automatic dishwashing machine 62.

Figure 6:
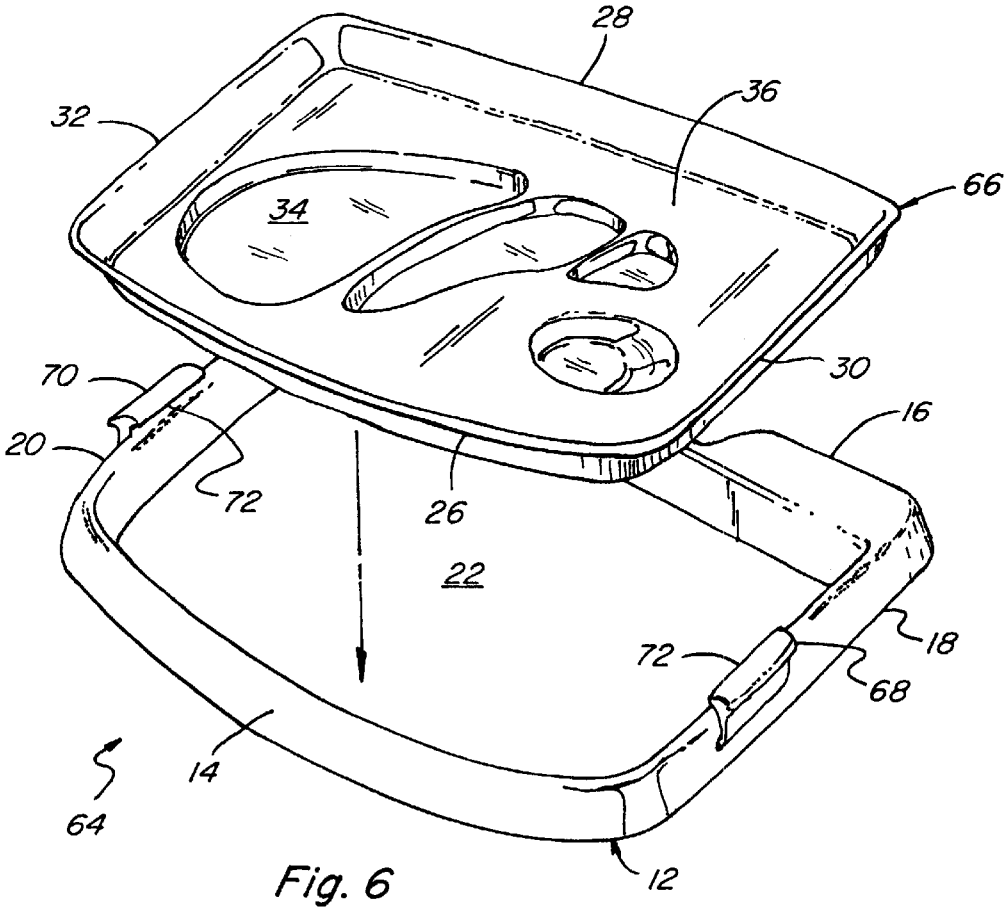
FIG. 6 is a perspective view of another tray assembly including a removable insert constructed and operable according to the teachings of the present invention.
Figure 7:
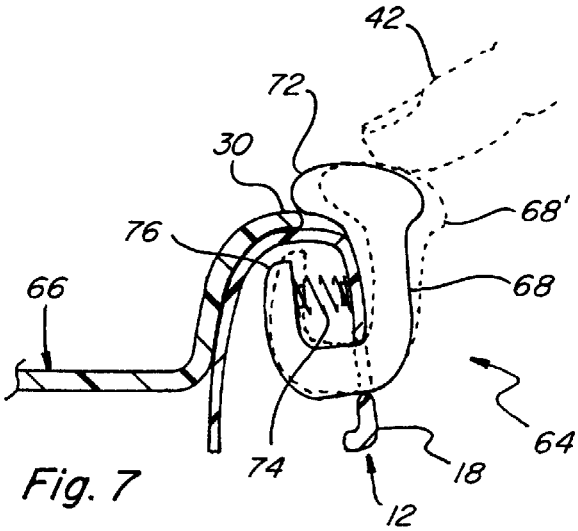
FIG. 7 is a fragmentary view of the tray assembly of FIG. 6, showing a side lip portion of a tray insert thereof engaged by a locking clip on a side peripheral edge of a frame thereof.

Referring to FIGS. 6 and 7, another tray or tray assembly 64 according to the present invention, adapted for use with a conventional highchair, such as highchair 48, is shown, like parts of tray assembly 64 and tray assembly 10 being identified by like numbers. Tray assembly 64 includes a frame 12 having a front peripheral edge portion 14, a rear peripheral edge portion 16, and left and right side peripheral edge portions 18 and 20 extending therebetween, defining a space 22. Tray assembly 64 includes a tray insert 66 which is essentially the same as tray insert 24, including a front peripheral lip portion 26, a rear peripheral lip portion 28, left side and right side peripheral lip portions 30 and 32, defining an area 34 spanned by a bottom portion 36, with the exception that tray insert 66 does not include a handle 38.

Instead, a pair of locking clips 68 and 70 are resiliently connected to left and right side peripheral edge portions 18 and 20, respectively, of frame 12, and includes tabs 72 engageable in overlaying relation to small portions of left and right side peripheral lip portions 30 and 32 of tray insert 66, for holding tray insert 66 in position in space 22 of frame 12, when locking clips 68 and 70 are in a locking position as shown. Locking clips 68 and 70 can be yieldably biased toward the locking position shown using any suitable elements, such as a conventional compression spring 74 positionable between an interior arm 76 of locking clip 68, 70, and an opposing interior surface of frame 12. Then, to release tray insert 66, locking clips 68, 70 need merely be retracted or moved outwardly away from tray insert 66, as denoted by 68', by application of finger pressure, as denoted at 42.

Tray insert 66 can be easily positioned on frame 12 and pressed downwardly in the vicinity of locking clips 68 and 70 so as to pass the clips and be locked in position thereby against frame 12. Then, when it is desired to remove the tray insert, light pressure is applied outwardly to one or both of locking clips 68 and 70 (using a hand or finger as denoted by 42) and the tray insert lifted past the locking clips.

Industrial Applicability

The trays and tray assemblies according to the present invention as described hereinabove and claimed hereinafter have utility for a wide variety of infant highchair constructions, as well as other chairs, such as wheelchairs, and stationary chairs for invalids, hospital patients, the elderly, and the like, as well as for use with other chairs, including chairs utilized in motor vehicles and public transportation vehicles, such as aircraft, railroad cars, ships, boats, and the like.

Additionally, it should be understood that the terms "front", "rear", "side", "top", and "bottom", are for reference purposes only, and do not limit the present invention in any way. For instance, for the tray assembly 10 shown in FIGS. 1–4, either of the side peripheral edge portions of the frame could be denoted as the front edge portion, likewise with the lip portions of the tray insert.

Further, it should be understood that the cooperatively engageable elements for holding rear lip portion 28 of the tray insert 24 on frame 12 can include other constructions, such as, but not limited to, an element which overlays or wraps around a portion of rear peripheral edge portion 14.

Thus, there has been shown and described several embodiments of a highchair tray with removable inserts, which fulfills all of the objects and advantages sought therefor. Many changes, modifications, variations, and other uses and applications of the present construction will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A tray assembly for an infant highchair, comprising:

a frame having a front peripheral edge portion, a rear peripheral edge opposite the front peripheral edge portion, and opposing side peripheral edge portions extending between the front and rear peripheral edge portions, the peripheral edge portions defining a space therebetween having a predetermined shape and size;

a tray insert having a front peripheral lip portion, a rear peripheral lip portion opposite the front peripheral lip portion, a pair of opposing side peripheral lip portions extending between the front and rear peripheral lip portions defining an area, and a bottom portion located in the area and connected to the peripheral lip portions, the tray insert having a predetermined shape and extent such that the front, rear and side peripheral lip portions can rest on the front, rear and side peripheral edge portions of the frame, respectively, for supporting the bottom of the tray insert in at least substantially covering relation to the space defined by the frame; and a handle on one of the peripheral lip portions of the tray insert having a shape when viewed from the side so as to releasably wrap partially around a portion of one of the peripheral edge portions of the frame when the lip portions of the tray insert are resting on the edge portions of the frame, and elements on one of the lip portions and on one of the edge portions, respectively, cooperatively engageable as said handle is releasably wrapped partially around said one peripheral edge portion, for holding said tray insert on said frame;

wherein the tray insert is removable from the frame by grasping with one hand and pulling the tray insert away from the frame to simultaneously release the handle and disengage the cooperatively engaged elements.

2. The tray assembly of claim 1, wherein the handle is located on the front peripheral lip portion of the tray insert and the elements are located on at least one of the side and rear peripheral edge portions of the frame.

3. The tray assembly of claim 2, wherein the elements on at least one of the side and rear peripheral edge portions of the frame and on at least a corresponding one of the side and rear lip portions of the tray insert are located on the rear peripheral edge portion and the rear peripheral lip portion, respectively, and comprise a tab on one of said portions cooperatively receivable in a receptacle in another of said portions.

4. The tray of claim 1, wherein at least the tray insert is made from a plastics material selected from the group consisting of a polycarbonate, a polystyrene, a polyethylene, and a acrylonitrile butadiene styrene.

5. The tray assembly of claim 1, wherein the bottom of the tray insert has a top surface including at least one toy mounted thereon.

6. A tray for an infant highchair, comprising:

a frame having a front peripheral edge portion, a rear peripheral edge portion opposite the front peripheral edge portion, and opposing side peripheral edge portions extending between the front and rear peripheral edge portions, the peripheral edge portions defining a space therebetween having a predetermined shape and size;

a tray insert having a front peripheral lip portion, a rear peripheral lip portion opposite the front peripheral lip portion, a pair of opposing side peripheral lip portions extending between the front and rear peripheral lip portions defining an area, and a bottom portion located in the area and connected to the peripheral lip portions, the tray insert having a predetermined shape and extent such that the peripheral lip portions can rest on the peripheral edge portions of the frame around the space of the frame for supporting the bottom of the tray insert in at least substantially covering relation to the space of the frame;

a handle on the front peripheral lip portion of the tray insert having a generally C shape profile when viewed from the side positioned so as to releasably wrap around a portion of the front edge portion of the frame when the side and rear lip portions of the tray insert are resting on the side and rear edge portions of the frame, respectively; and elements on at least one of the peripheral edge portions of the frame and on at least a corresponding one of the lip portions of the tray insert cooperatively engageable as the handle is being positioned around the portion of the front edge portion of the frame, such that the handle and the cooperatively engaged elements will hold the tray insert on the frame;

wherein the tray insert is removable from the frame by grasping the tray insert with one hand and pulling the tray insert upwardly to simultaneously release the handle from the front peripheral edge portion and disengage the cooperatively engaged elements.

7. The tray of claim 6, wherein at least the tray insert is made from a plastics material selected from the group consisting of a polycarbonate, a polystyrene, a polyethylene, and a acrylonitrile butadiene styrene.

8. The tray of claim 6, wherein the bottom of the tray insert has a top surface including at least one toy mounted thereon.

9. A tray for an infant highchair, comprising:

a frame having a front peripheral edge portion, a rear peripheral edge opposite the front peripheral edge portion, and opposing side peripheral edge portions extending between the front and rear peripheral edge portions, the peripheral edge portions defining a space therebetween having a predetermined shape and size;

a tray insert having a front peripheral lip portion, a rear peripheral lip portion opposite the front peripheral lip portion, a pair of opposing side peripheral lip portions extending between the front and rear peripheral lip portions defining an area, and a bottom portion located in the area and connected to the peripheral lip portions, the tray insert having a predetermined shape and extent such that the peripheral lip portions can rest on the peripheral edge portions of the frame for supporting the bottom of the tray insert in at least substantially covering relation to the space of the frame;

locking clips extending upwardly from the side peripheral edge portions of the frame and yieldably biased toward the space, the locking clips being resiliently yieldable by applying a force thereagainst in a direction away from the space to allow positioning the tray insert on the frame, and the locking clips being cooperatively engageable with the side peripheral lips of the tray insert when resting on the side peripheral edge portions of the frame when the force is removed for releasably holding the tray insert on the frame, the tray insert being removable from the frame by applying a force against at least one of the locking clips in a direction away from the tray insert and lifting the tray insert from the frame.

10. The tray of claim 9, wherein at least the tray insert is made from a plastics material selected from the group consisting of a polycarbonate, a polystyrene, a polyethylene, and a acrylonitrile butadiene styrene.

11. The tray of claim 9, wherein the bottom of the tray insert has a top surface including at least one toy mounted thereon.

12. The tray of claim 6 wherein the elements are located on the rear peripheral edge portion of the frame and on the rear lip portion of the tray insert.

13. The tray of claim 12, wherein the elements comprise a tab on one of said portions cooperatively receivable in a recess in another of said portions.

14. A tray assembly for an infant highchair, comprising:

a frame having a front peripheral edge portion, a rear peripheral edge opposite the front peripheral edge portion, and opposing side peripheral edge portions extending between the front and rear peripheral edge portions, the peripheral edge portions defining a space therebetween having a predetermined shape and size;

a tray insert having a front peripheral lip portion, a rear peripheral lip portion opposite the front peripheral lip portion, a pair of opposing side peripheral lip portions extending between the front and rear peripheral lip portions defining an area, and a bottom portion located in the area and connected to the peripheral lip portions, the tray insert having a predetermined shape and extent such that the front, rear and side peripheral lip portions can rest on the front, rear and side peripheral edge portions of the frame, respectively, for supporting the bottom of the tray insert in at least substantially covering relation to the space defined by the frame;

a handle on the front peripheral lip portion of the tray insert having a generally C shape profile when viewed from the side positioned so as to releasably wrap securely around a sufficient portion of the front peripheral edge portion of the frame for holding the front lip portion of the tray insert thereon when the side and rear lip portions of the tray insert are resting on the side and rear edge portions of the frame, respectively; and elements on at least the rear peripheral edge portion of the frame and on the rear lip portion of the tray insert cooperatively engageable when the front peripheral lip portion of the tray insert is held on the frame, the elements comprising a tab on one of said portions cooperatively receivable in a receptacle on another of said portions.

15. A tray assembly for an infant highchair, comprising:

a frame having a front peripheral edge portion, a rear peripheral edge opposite the front peripheral edge portion, and opposing side peripheral edge portions extending between the front and rear peripheral edge portions, the peripheral edge portions defining a space therebetween having a predetermined shape and size;

a tray insert having a front peripheral lip portion, a rear peripheral lip portion opposite the front peripheral lip portion, a pair of opposing side peripheral lip portions extending between the front and rear peripheral lip portions defining an area, and a bottom portion located in the area and connected to the peripheral lip portions, the tray insert having a predetermined shape and extent such that the front, rear and side peripheral lip portions can rest on the front, rear and side peripheral edge portions of the frame, respectively, for supporting the bottom of the tray insert in at least substantially covering relation to the space defined by the frame;

a handle on one of the peripheral lip portions of the tray insert, the handle having a generally C shape profile when viewed from the side positioned so as to releasably wrap securely around a sufficient portion of a corresponding one of the peripheral edge portions of the frame when the lip portions of the tray insert are resting on the edge portions of the frame, and elements on one of the peripheral edge portions of the frame and on a corresponding one of the lip portion of the tray insert cooperatively engageable as the handle is being positioned around the portion of the corresponding one of the peripheral edge portions of the frame for holding the tray insert on the frame in cooperation with the handle, the elements comprising a tab on one of said portions cooperatively receivable in a receptacle on another of said portions.

16. The tray assembly of claim 15, wherein the tab and the receptacle are located on the rear ones of said portions.

17. The tray assembly of claim 15, wherein the elements are disengageable simultaneously as the handle is released from the one of the peripheral edge portions of the frame for removing the tray insert from the tray.

18. A tray assembly for an infant highchair, comprising a frame having a peripheral edge;

a tray insert having a bottom portion and a peripheral lip bounding said bottom portion, and having a handle with a generally C shape profile when viewed from the side, said tray insert being positionable on said frame so that said peripheral lip is supported on said peripheral edge around said bottom portion, said bottom portion is disposed within said peripheral edge, and said handle is releasably engaged with a sufficient portion of said peripheral edge of said frame to hold said tray insert thereon.

19. The tray assembly of claim 18, wherein said tray insert is removable from said frame by pulling said handle away from said peripheral edge to release said handle from said peripheral edge.

20. The tray assembly of claim 18, further comprising elements on said peripheral edge and on said peripheral lip cooperatively engageable when said tray insert is disposed on said frame.

21. The tray assembly of claim 20 wherein said elements include a receptacle and a tab.

22. A tray insert removably disposable within a cavity of a frame, the frame including a peripheral edge, said tray insert comprising:

a bottom portion;

a peripheral lip bounding said bottom portion; and an element on said peripheral lip configured to releasably engage a corresponding element on said peripheral edge when said tray insert is disposed on the frame, said tray insert being positionable within the cavity of the frame such that said peripheral lip overlaps a portion of the peripheral edge along the entire periphery of the peripheral edge, said bottom portion is disposed within said peripheral edge, and said element on said peripheral lip releasably engages the element on the peripheral edge.

23. The tray insert of claim 22, wherein said elements include a receptacle and a tab.

24. The tray insert of claim 22, wherein said bottom portion comprises an upper surface having a plurality of sections formed therein.

25. A tray assembly for an infant highchair, comprising:

a frame having a peripheral edge;

a tray insert having a bottom portion, a peripheral lip bounding said bottom portion, and a handle configured to releasably engage a portion of said peripheral edge, said tray insert being positionable on said frame so that said peripheral lip is supported on said peripheral edge along the entire periphery of said peripheral edge, said bottom portion is disposed within said peripheral edge, and said handle is releasably engaged with said peripheral edge of the frame to maintain said tray insert thereon.

26. The tray assembly of claim 25, wherein said tray insert is removable from said frame by pulling said handle away from said peripheral edge to release said handle from said peripheral edge.

27. The tray assembly of claim 25, further comprising elements disposed on said handle and said peripheral edge, said elements configured to cooperatively engage when said tray insert is disposed on said frame.

28. The tray assembly of claim 27, wherein said elements include a receptacle and a tab.

29. The tray assembly of claim 25, wherein said handle has a generally shape profile when viewed from the side.

30. The tray assembly of claim 25, wherein said tray insert further comprises a plurality of sections formed in an upper surface of said bottom portion.

31. A tray assembly for an infant highchair, comprising:

a frame having a peripheral edge;

a tray insert having a bottom portion including a plurality of sections formed in an upper surface of said bottom portion, a peripheral lip bounding said bottom portion, and a handle with a generally C shape profile when viewed from the side and configured to releasably engage a portion of said peripheral edge, said tray insert being positionable on said frame so that said peripheral lip is supported on said peripheral edge along the entire periphery of said peripheral edge and said bottom portion is disposed within said peripheral edge, and said handle is releasably engaged with said peripheral edge of the frame to maintain said tray insert thereon.

32. The tray assembly of claim 31, further comprising elements disposed on said handle and said peripheral edge, said elements configured to cooperatively engage when said tray insert is disposed on said frame.

33. The tray assembly of claim 32, wherein said elements include a receptacle and a tab.

* * * * *

UNITED STATES PATENT AND TRADEMARK OFFICE

CERTIFICATE OF CORRECTION

PATENT NO. : 6,578,496 B2 
DATED : June 17, 2003
INVENTOR(S) : Tony Michael Guard et al.

It is certified that error appears in the above-identified patent and that said Letters Patent is hereby corrected as shown below:

Column 10,
Line 20, after "generally", insert -- C --.

Signed and Sealed this

Ninth Day of September, 2003

JAMES E. ROGAN
*Director of the United States Patent and Trademark Office*